US006088998A

United States Patent [19]

Malin et al.

[11] Patent Number: 6,088,998

[45] Date of Patent: Jul. 18, 2000

[54] HIGH COMPRESSION TRANSVERSE ZIPPER SYSTEM

[75] Inventors: Art Malin, Northbrook; Ronald L. Ramsey, Naperville; Lawrence Share, Skokie, all of Ill.; Richmond M. Scott, Pleasantville, N.Y.

[73] Assignee: Illinois Tool Works Inc., Glenview, Ill.

[21] Appl. No.: 09/114,618

[22] Filed: Jul. 13, 1998

[51] Int. Cl.[7] ..... B65B 51/04; B65B 61/18; B65D 33/16

[52] U.S. Cl. ..... 53/416; 53/133.4; 53/139.2; 53/451; 53/551; 493/214; 493/927

[58] Field of Search ..... 53/416, 410, 139.2, 53/133.4, 451, 450, 551, 550, 552, 553, 554, 555; 493/214, 213, 927

[56] References Cited

U.S. PATENT DOCUMENTS

| | | | |
|---|---|---|---|
| 2,558,367 | 6/1951 | Madsen | 24/201 |
| 2,637,085 | 5/1953 | Madsen | 24/201 |
| 3,633,642 | 1/1972 | Siegel | 150/3 |
| 4,430,070 | 2/1984 | Ausnit | 493/215 |
| 4,601,694 | 7/1986 | Ausnit | 493/381 |
| 4,617,683 | 10/1986 | Christoff | 53/451 X |
| 4,673,383 | 6/1987 | Bentsen | 493/381 |
| 4,892,512 | 1/1990 | Branson | 493/214 X |
| 4,909,017 | 3/1990 | McMahon et al. | 53/410 |
| 5,276,950 | 1/1994 | Johnson | 24/587 |
| 5,492,411 | 2/1996 | May | 493/214 X |
| 5,558,613 | 9/1996 | Tilman et al. | 493/214 |
| 5,592,802 | 1/1997 | Malin et al. | 53/133.4 |
| 5,816,018 | 10/1998 | Bois | 53/139.2 X |

*Primary Examiner*—James F. Coan
*Attorney, Agent, or Firm*—Pitney, Hardin, Kipp & Szuch LLP

[57] ABSTRACT

A zipper strip for a reclosable package having a transverse zipper is provided. The zipper strip comprises a male interlocking profile and a female interlocking profile. Each profile includes an interlocking member and an integral web which defines a trailing flange. One or both of the profiles are provided with high compression members which allow one or both of the interlocking members to be sealed to thermoplastic film without being crushed or distorted.

15 Claims, 5 Drawing Sheets

HIGH COMPRESSION TRANSVERSE ZIPPER SYSTEM

BACKGROUND OF THE INVENTION

1. Field of the Invention

The present invention relates to reclosable plastic bags and packages of the type in which food products, such as chips and cereal, and other goods are packaged for sale to consumers. More particularly, the present invention relates to a reclosable zipper strip for use in transverse-zippered reclosable plastic bags made on form-fill-seal (FFS) machines.

2. Description of the Prior Art

The present invention relates to improvements in the package-making art and may be practiced in the manufacture of thermoplastic bags and packages of the kind that may be used for various consumer products, but which are particularly useful for food products which must be kept in moisture and air-tight packages, free from leakage until initially opened for access to the product contents, which packages are then reclosable by zipper means to protect any remainder of the product therein.

The prior art is fairly well-developed, but nevertheless remains susceptible to improvement contributing to increased efficiency and cost effectiveness.

In particular the present invention relates to the area of reclosable packaging known as the transverse zipper. When making a bag having a transverse zipper, the zipper is attached transverse to the longitudinal axis of the material used to make the bag, as opposed to being attached to the material parallel to the longitudinal axis. A method and apparatus for making reclosable plastic bags with a transverse zipper on a FFS machine is disclosed in U.S. Pat. No. 4,909,017.

Prior to the introduction of the transverse zipper to the reclosable packaging field, reclosable plastic bags made on FFS machines were typically made with a continuous longitudinal zipper, i.e. a zipper parallel to the longitudinal axis of the thermoplastic film used to make the bags. However, there are two primary problems with the longitudinal zipper technique. First, there is a problem in attaining satisfactory sealing of the bags against leakage since the transverse, or side, sealing bars of the FFS machine must flatten and seal the zipper at the same time they are sealing the thermoplastic film from which the packages are being made. The difficulty with which this sealing is consistently and successfully achieved is reflected by the high occurrence of leaking packages.

Second, the length of reclosable bags made on FFS machines when the zipper is attached parallel to the longitudinal axis of the thermoplastic film is limited to the diameter of the filling tube of the FFS machine. Thus, generally bags of this type are wider than they are long. While such bags are suitable for certain products where shorter bags are desirable, such as cheese and chicken parts, these bags are not suitable for applications in which longer bags are desirable, for example chips and other snack foods.

Among the approaches taken to solve these problems has been the substitution of a transverse zipper for the longitudinal zipper. When a transverse zipper is provided, the transverse sealing bars associated with the FFS machine do not flatten the zipper during formation of the top and bottom seals of the package since the transverse sealing bars may seal the zipper to the thermoplastic film transversely thereacross without having to flatten the zipper ends. In addition, when a transverse zipper is used the length of the packages made on the FFS machine can be varied while the width of the zipper remains the same.

The present invention relates to a particular type of zipper strip which may be used in transverse zipper applications, a method for attaching the zipper strip to thermoplastic film, a method for making reclosable packages on an FFS machine using the zipper strip-equipped thermoplastic film, and a reclosable package utilizing the zipper strip.

FIG. 1 depicts a cross section of a prior art reclosable plastic bag 10 made on an FFS machine having a transverse zipper strip 12 disposed at the top of the bag. The zipper strip 12 has a male profile 14 interlocked with a female profile 16. The male profile 14 has a male interlocking member 18 and a web 20 defining a trailing flange 22. The female profile 16 has a female interlocking member 24 and a web 26 defining an extended leading flange 28 and a trailing flange 30 on either side of the interlocking member.

The zipper strip 10 is initially secured to the thermoplastic film used to make the bag by sealing the extended leading flange 28 thereto. The thermoplastic film with the zipper strip thus initially sealed thereto is fed into an FFS machine where the bag is formed and the final zipper seals made by sealing the trailing flanges 22, 30 to the opposing bag walls 32, 34. The zipper strip is thus secured to the bag at three locations, denoted in FIG. 1 as seals A, B and C.

This three point seal technique, however, has proven problematic in some cases. As shown in FIG. 2, when the consumer attempts to open the bag from below the zipper by pulling outwardly on the bag walls as depicted by forces F, the female interlocking member 24 rotates and a resultant peel force S is induced at seal C. The result is that seal C is put under a relatively high peel stress, thereby weakening the seal and making detachment of the zipper strip from the bag via a peeling action likely.

It is therefore an object of the present invention to provide a zipper strip for use in transverse-zippered reclosable plastic bags which does not have the aforementioned peel problem. Another object of the present invention is to provide a method for attaching the zipper strip to thermoplastic film, which thermoplastic film can later be used on an FFS machine to make reclosable packages. Another object of the present invention is to provide a method for making packages from the zipper strip-equipped thermoplastic film. Yet another object of the present invention is to provide a package which utilizes the zipper strip.

SUMMARY OF THE INVENTION

Accordingly, the present invention is, in four aspects, a zipper strip for use with transverse zippered bags, a method for attaching the zipper strip to a continuous supply of thermoplastic film, a method for making reclosable bags on an FFS machine using the zipper strip-equipped thermoplastic film, and a reclosable bag utilizing the zipper strip.

In accordance with the first aspect of the present invention, the zipper strip comprises a male profile and a female profile for mating with the male profile. The male profile includes a male interlocking member and a web defining a trailing flange. Likewise, the female profile includes a female interlocking member and a web defining a trailing flange. The male interlocking member is engageable within the female interlocking member to join the male and female interlocking profiles together. One or both of the interlocking members is provided with high compression members which allows at least one of the interlocking members to be sealed to the bag without being crushed or distorted due to the application of heat and pressure directly behind or closely adjacent to the interlocking members by the FFS machine sealing bars, thereby eliminating the peel problem associated with the three point seal technique discussed above.

In the second aspect of the present invention, thermoplastic film is intermittently paid off a continuous supply of the same and fed into an FFS machine. A length of the interlocked zipper strip is attached to the flat film transverse to its longitudinal axis each time it is brought to rest as it advances in bag-length increments. The zipper-equipped film may be rolled up and used on an FFS machine at a later time, or may be fed directly into an FFS machine to make reclosable bags.

In the third aspect of the present invention, the thermoplastic film with the transverse zipper strips attached at bag length intervals is fed into the FFS machine where it is formed into a bag, filled, and sealed. Specifically, the transverse zipper-equipped thermoplastic film is folded over the collar of the FFS machine and wrapped around the filling tube to form a tube. The longitudinal edges of the film are then sealed to form a back seam. The transverse sealing jaws then seal the bottom of the tube to form an open bag. The bag is then filled, if desired. Finally, the transverse sealing jaws seal the trailing flanges of the zipper strip to adjacent bag walls without sealing them to each other, seal at least one of the interlocking members to one of the bag walls without crushing or distorting the interlocking members, and seal the top of the bag so as to make a completed bag.

In accordance with the fourth aspect of the present invention, the finished bag may be opened by pulling outwardly on the bag walls.

The present invention will now be described in more complete detail with frequent reference being made to the figures identified below.

DETAILED DESCRIPTION OF THE PREFERRED EMBODIMENTS

Figure 3:
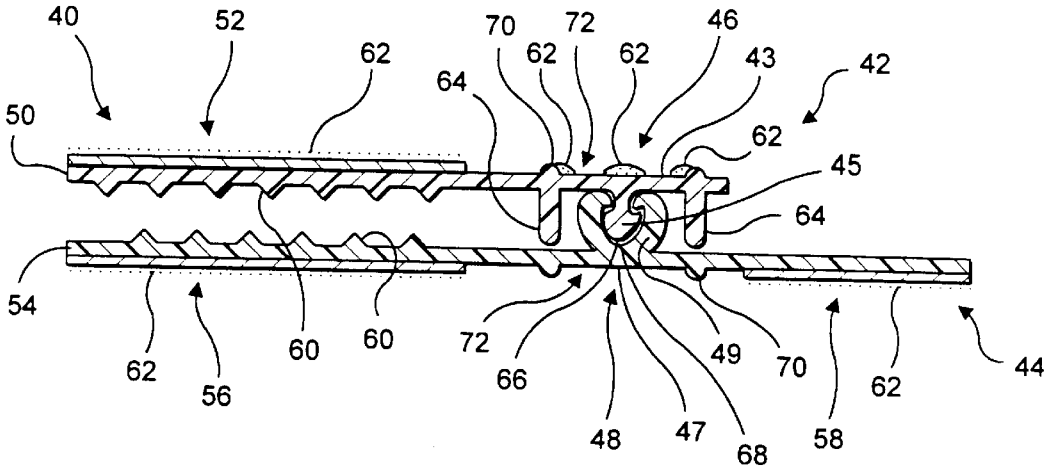
FIG. 3 is a cross-sectional view of a zipper strip in accordance with a first embodiment of the present invention.

Referring specifically to the figures identified above, FIG. 3 is a cross-sectional view of a zipper strip 40 in accordance with the first aspect of the present invention.

The zipper strip 40 comprises a male profile 42 and a female profile 44. The male profile 42 includes a male interlocking member 46 having a base 43 and a male portion 45 integral with the base 43. The male portion 45 may have an arrow-shaped cross-section, or as shown in FIG. 3, an asymmetrical arrow-shaped cross section designed to make the zipper strip 40 easier to open from one side or the other. The female profile 44 includes a female interlocking member 48 having a base 47 and a female portion 49 integral with the base 47. The female portion 49 is comprised of two inwardly curving members forming a receptacle or channel into which the male portion 45 may be engaged. It should be noted that while these configurations for male and female portions 45, 49 are preferred, any configuration which provides for interlocking may be used.

The male profile 42 includes a web 50 which extends laterally from one side of the male interlocking member 46 defining a trailing flange 52. The female profile 44 similarly includes web 54 which defines a trailing flange 56, as well as an extended leading flange 58. The extended leading flange 58 is so-called because it extends beyond the opposing male profile 42 and because it is the flange that first enters the FFS machine as the zipper strip 40 is attached to the thermoplastic film, as discussed more fully below. The extended leading flange may alternatively be provided on the male profile 42 if desired, or neither profile may have a leading flange.

The webs 50, 54 are integral with the interlocking members 46, 48 and are generally coextruded therewith, although they may be extruded separately and attached at a later time. The profiles are extruded from a plastic material commonly used in the packaging industry, such as polyethylene. In addition, the profiles may contain a heat activated adhesive 62 which helps in the sealing of the profiles to the thermoplastic material which is used to make the packages.

The male interlocking member 46 further includes high compression members 64 on either side of the male portion 45 extending from the base 43. The high compression members 64 are longer than the male portion 45 so that while the male interlocking member 46 is being sealed to the thermoplastic film, the high compression members 64 engage the base 47 of the female interlocking member 48 and thereby prevent the male and female portions 45, 49 from being distorted or crushed by the heat and pressure applied by the FFS machine sealing bars. The length of the high compression members 64 is such that the high compression members 64 engage the female base 47 before the apex 66 of the male portion 45 engages the nadir 68 of the female portion 49, thus preventing the compression and ultimate crushing and distortion of the male and female portions. It should be noted that the same result can be achieved by placing the high compression members 64 on the female interlocking member 48, or on both the male interlocking member 46 and the female interlocking member 48.

The profiles may also included ridges 70 aligned with the high compression members 64 which form indentations 72 on both profiles, which indentations enable the user to better manipulate the zipper during closing. The ridges 70 also provide an added function in that the sealing bars which will seal the interlocking member or members to thermoplastic film will directly contact the ridges 70 only, and not the portion of the base directly behind the male or female portion, ensuring that the heat and pressure are transmitted to the high compression members 64 and not the male and female portions 45, 49, which transmission could cause irreparable distortion of the interlocking members.

Gripping members 60 can also be provided which will facilitate the opening of a package incorporating the zipper strip 40.

As discussed above, a heat activated adhesive 62 is used to aid in the sealing of the zipper strip 40 to the thermoplastic film. As shown in FIG. 3, the heat activated adhesive 62 is placed on the trailing flanges 52, 56, on the extended leading flange 58, behind the male portion 45, and behind the ridges 62 on the male interlocking member 46. Heat activated adhesives are commercially available and are well known in the reclosable packaging art. By placing the adhesive adjacent the ridges but inside such ridges the sealing can be controlled and the sealant cannot move outwardly of the ridges.

Figure 4:
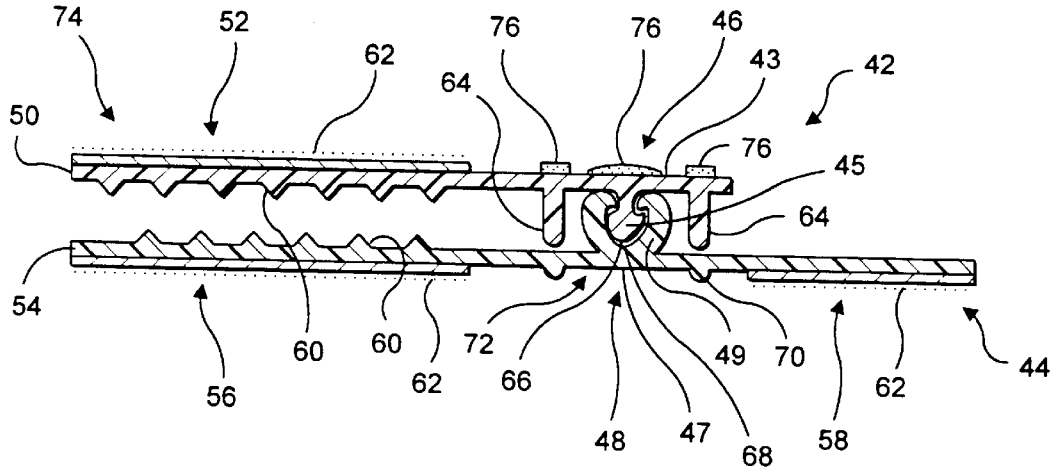
FIG. 4 is a cross-sectional view of a zipper strip in accordance with a second embodiment of the present invention.

FIG. 4 depicts a zipper strip 74 in accordance with a second embodiment of the present invention. The zipper strip 74 is identical to the zipper strip 40 of FIG. 3 except that the male interlocking member 46 does not have ridges 70. Instead, there are three spaced strips 76 of heat activated adhesive behind the male interlocking member.

Figure 5:
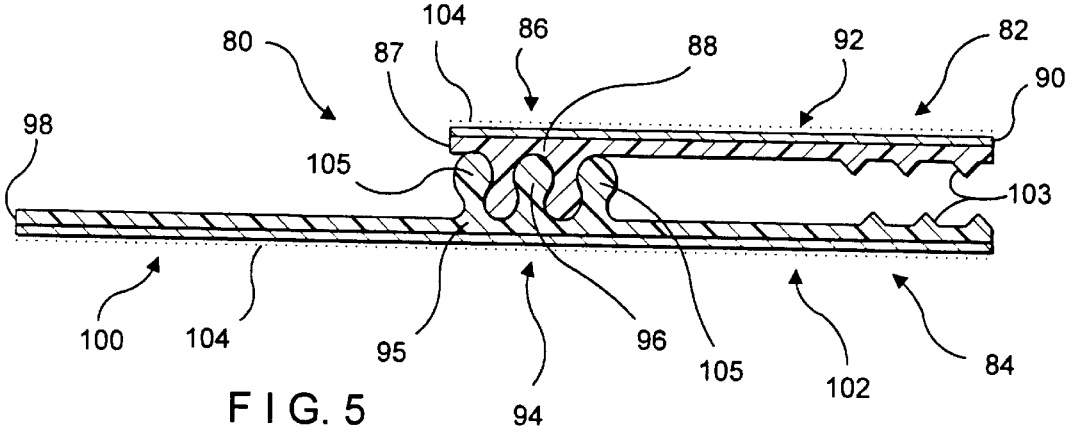
FIG. 5 is a cross-sectional view of a zipper strip in accordance with a third embodiment of the present invention.

FIG. 5 depicts a zipper strip 80 in accordance with a third embodiment of the present invention. The zipper strip 80 has a female profile 82 and a male profile 84. The female profile 82 includes a female interlocking member 86 having a base 87 and a female portion 88 comprised of two projections having generally rounded cross-sections extending therefrom to form a channel, and a web 90 which defines a trailing flange 92. The male profile 84 includes a male interlocking member 94 having a base 95 and a rounded projecting member defining a male portion 96 extending therefrom which is engageable within the channel of the female profile 82 and a web 98 which defines an extended leading flange 100 and a trailing flange 102. Both profiles are provided with a heat activated adhesive 104 along their lengths to facilitate sealing as well as gripping members 103 which facilitate the opening of a package incorporating the zipper strip 80 by the consumer.

A pair of high compression members 105 in the form of rounded members extend from the base 95 of the male interlocking member 94 towards the female interlocking member 86. As one or both of the interlocking members are sealed to thermoplastic film, the high compression members contact the base 87 of the female interlocking member 86. Because of their rounded shape and relatively thick cross sections, the high compression members 105 can withstand substantial heat and pressure and thereby ensure that the male and female portions will not be crushed or distorted. In addition, the male and female portions 88, 96 are provided with shapes similar to the high compression members to further protect them from damage. The first and second webs 90, 98 may thus be sealed across their width to thermoplastic film without risk of damaging the male and female portions.

Figure 6:
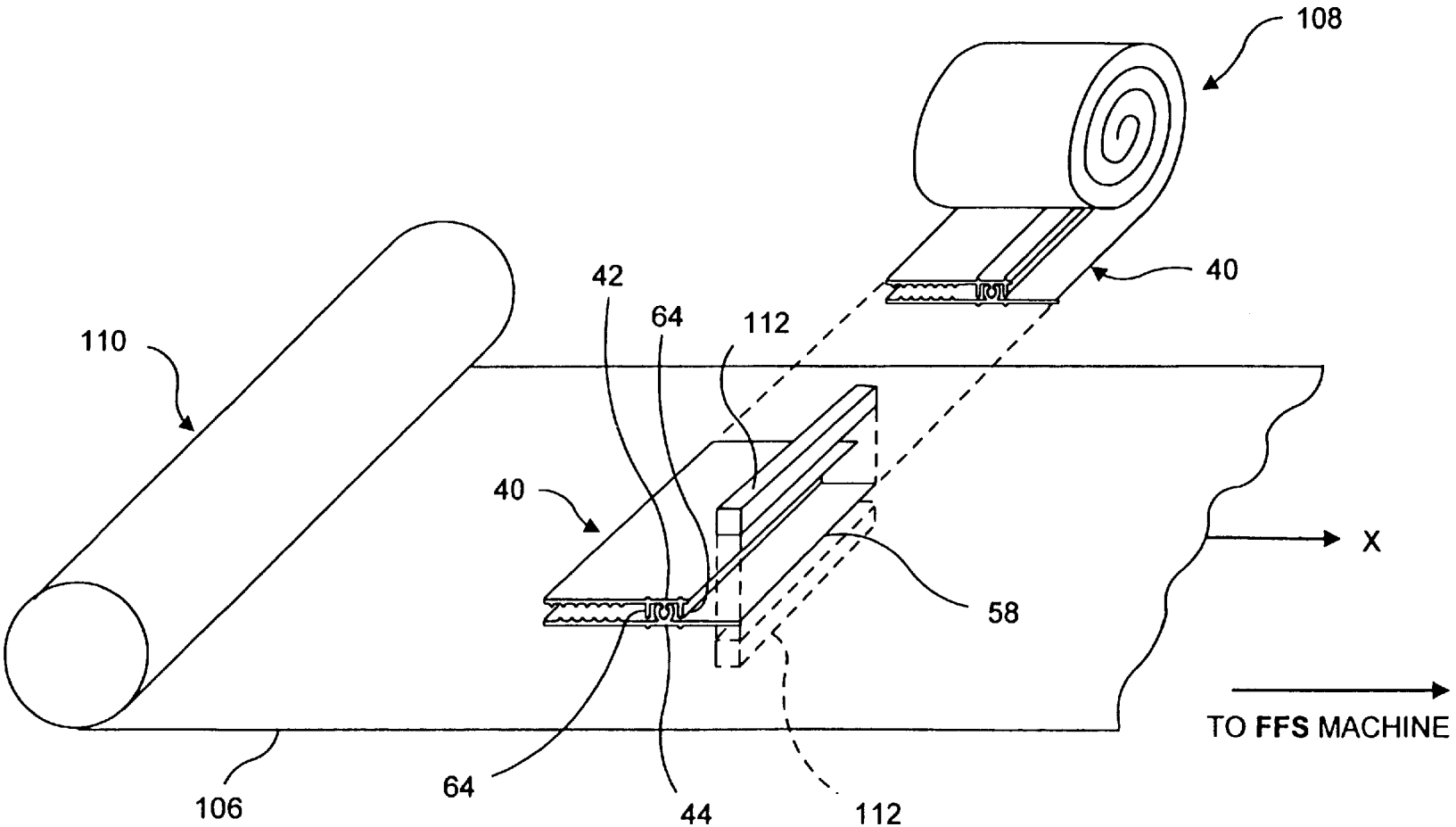
FIG. 6 is a perspective view of a zipper strip in accordance with the first embodiment of the present invention being attached to thermoplastic film.

FIG. 6 depicts how the zipper strip 40 of FIG. 3 is attached to thermoplastic film 106 in accordance with the second aspect of the present invention. The zipper strip is supplied from a continuous roll 108 and is pulled across the film 106 and disposed thereon by a positioning device 125 (not shown in FIG. 6 for clarity). The positioning device 125 can take any of a variety of forms well known to those skilled in the reclosable packaging art, such as a vacuum conveyor for pulling the zipper strip 40 across the film 106 and a knife for cutting the zipper strip 40 from the continuous roll thereof 108.

The thermoplastic film 106 is paid off from a continuous roll 110, as shown in FIG. 6, in increments equal to the length of the bags which will ultimately be formed from the film 106 on an FFS machine. The film 106 has a longitudinal axis X which is parallel to the direction of travel of the film 106. Each time the film 106 comes to rest, the zipper strip 40 is disposed on the film 106 transverse to the longitudinal axis X with the male profile 42 on top of the female profile 44 and the extended leading flange 58 projecting in the direction of motion of the film 106. As disclosed in U.S. Pat. No. 4,909,017, the zipper strip 40 has a length approximately equal to half the width of the film 106 and is disposed centrally thereon. Heater seal bars 112 are positioned to seal the extended leading flange 58 to the film 106. When no extended leading flange is used, the high compression members 64 make it possible to seal the female interlocking member to the thermoplastic film 106.

Figure 7:
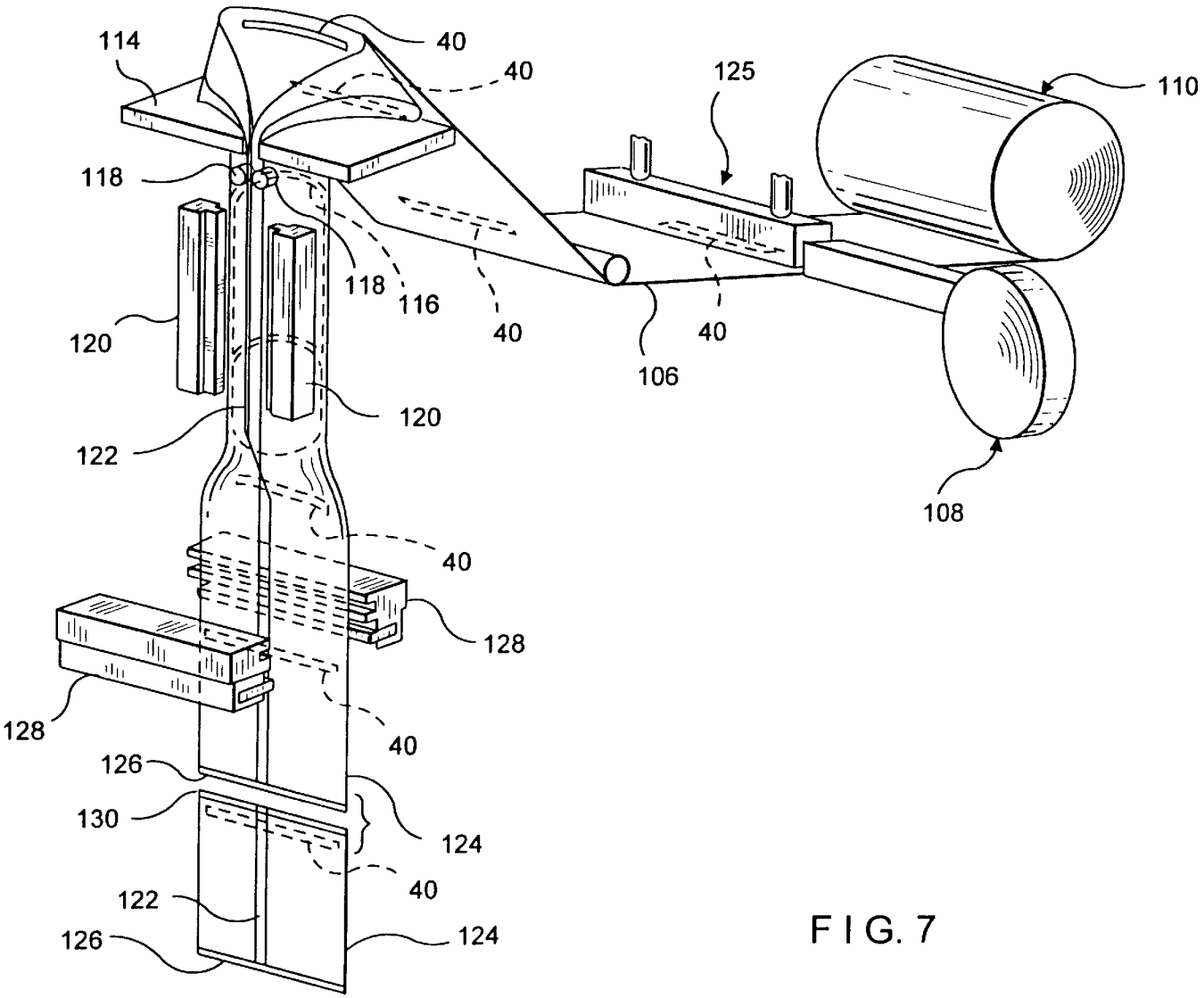
FIG. 7 is a perspective view of an FFS machine making reclosable bags from thermoplastic film.

In the third aspect of the present invention, the transverse zipper-equipped film is fed into a FFS machine, as shown in FIG. 7. The thermoplastic film 106 is fed downwardly over collar 114 and folded around filling tube 116. The edges of the film are brought together and could be pressed together by a pair of rollers 118. The edges are then welded together by heater bars 120 to form a longitudinal back seam 122. Contents may then be dropped through the tube 116 into the bag 124 which has a lower seam 126. As discussed below, the lower seam 126 was made when the preceding bag was completed.

After introduction of the contents, the top of the bag is completed by the action of cross seal jaws 128, which perform four simultaneous functions. First, the cross seal jaws 128 seal the female trailing flange 56 to one of the bag walls and seal the male trailing flange 52 and the male interlocking member 46 to the opposing bag wall. The heat activated adhesive 62 makes it possible to complete these seals without sealing the profiles 42, 44 to each other and the high compression members 64 prevent the interlocking members 46, 48 from being crushed and distorted during sealing. While only the male interlocking member 46 is sealed to the bag, it should be noted that both interlocking members may be sealed if so desired, as in the case of the zipper strip 80 of FIG. 5. Second, the cross seal jaws 128 seal the top of the bag to form a pilfer evident seal 130. Third, the cross seal 128 jaws make the lower seam 126 for the next succeeding bag. And fourth, the cross seal jaws 128 cut the completed bag 124 from the film 106. The completed bag 124 has a pilfer evident seal 130, a transverse zipper 40, a lower seam 126 and a back seam 122.

Figure 1:
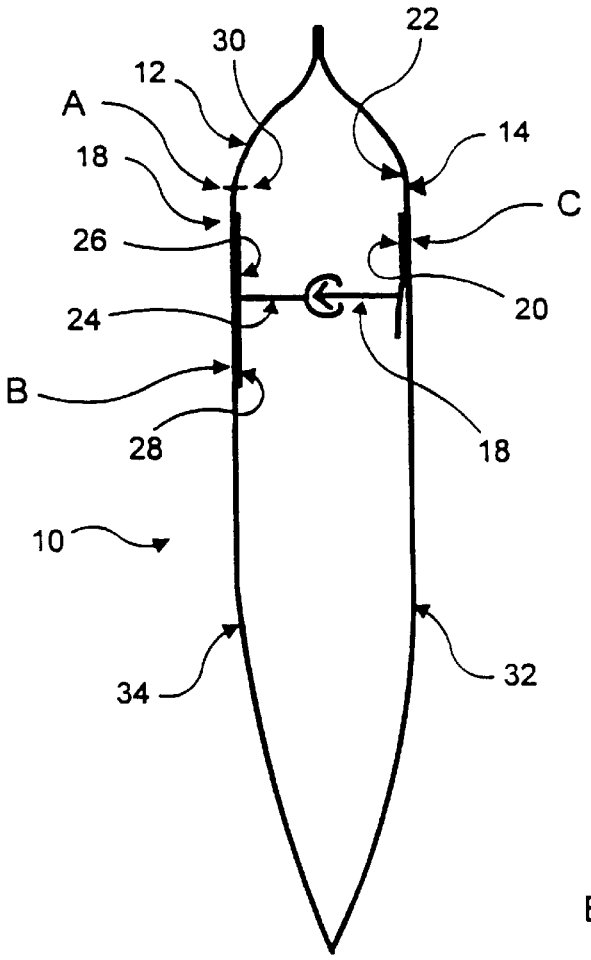
FIG. 1 PRIOR ART
FIG. 1 is a cross-sectional view of a reclosable bag having a prior art zipper strip.
Figure 2:
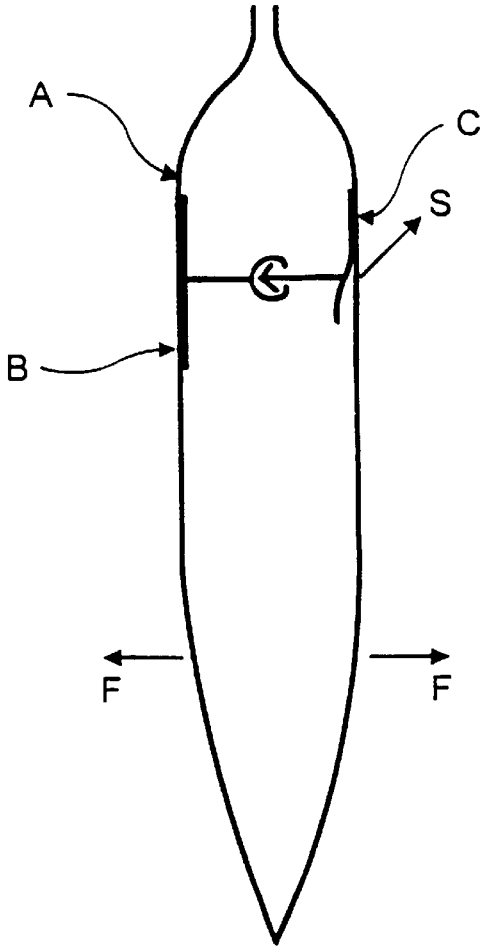
FIG. 2 PRIOR ART
FIG. 2 is a cross-sectional view of a reclosable bag having a prior art zipper strip being opened.
Figure 8:
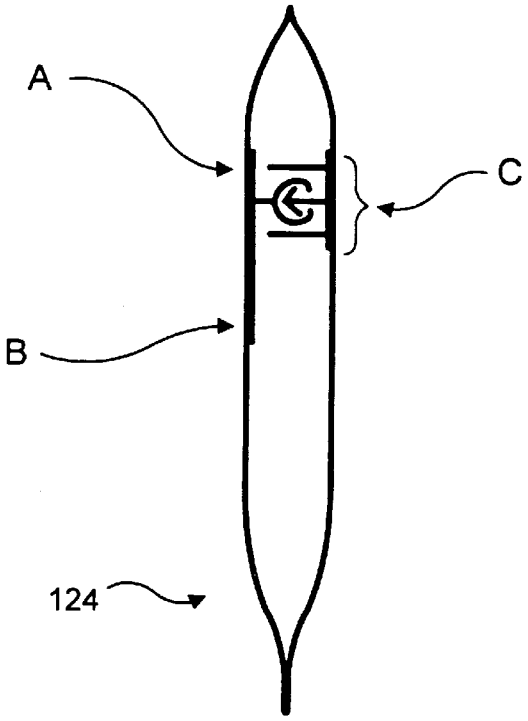
FIG. 8 is a cross-sectional view of a completed bag having a zipper strip in accordance with the first embodiment of the present invention.
Figure 9:
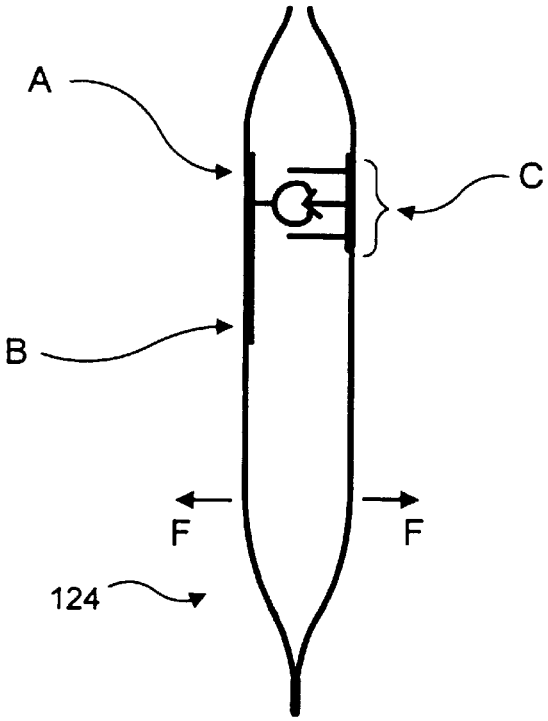
FIG. 9 is a cross-sectional view of a completed bag having a zipper strip in accordance with the first embodiment of the present invention being opened.

In accordance with the fourth aspect of the present invention, a cross section of the completed bag 124 is shown in FIG. 8. The zipper strip 40 is sealed to the bag at A, B and C. However, unlike in FIG. 1 seal C extends behind the male interlocking member 46. The result is that when the bag is opened by the consumer there is no rotation of the male interlocking member, as shown in FIG. 9 and as compared to FIG. 2, and thus the peel force on seal C is greatly reduced and there is no danger of peeling of the male profile from the bag.

Modifications to the above would be obvious to those of ordinary skill in the art, but would not bring the invention so modified beyond the scope of the appended claims.

We claim:

1. A method for attaching a zipper strip transversely to thermoplastic film for use in the production of reclosable packages to be made on a form-fill-seal machine from said thermoplastic film, said method comprising the steps:

providing thermoplastic film having a longitudinal axis and advancing said thermoplastic film along said axis in amounts equal in length to that of said packages;

providing a length of zipper strip having interlocked male and female profiles; said male interlocking profile including a male interlocking member and an integral web defining a male trailing flange, said male interlocking member including a base and a male portion extending from said base; said female interlocking profile including a female interlocking member and an integral web defining a female trailing flange, said female interlocking member including a base and a female portion extending from said base, said male portion being engageable within said female portion to join said male and female interlocking profiles together; at least one of said interlocking members further including at least one high compression member extending from its corresponding base toward the other interlocking member, said at least one high compression member being contactable with the base of other interlocking member when said profiles are interlocked and pressed together so that said interlocking members can be sealed to said thermoplastic film through the application of heat and pressure without damaging or distorting said male and female portions;

disposing said length of zipper strip upon said film transversely to said longitudinal axis with one of said profiles positioned above the other of said profiles and said trailing flanges directed opposite to the direction of motion of said thermoplastic film each time said film is brought to rest; and sealing the lower of said profiles to said thermoplastic film.

2. A method according to claim 1 wherein said lower of said profiles further includes a leading flange extending beyond the other profile which is sealed to said thermoplastic film.

3. A method of making reclosable packages comprising the steps of:

providing thermoplastic film having a longitudinal axis and advancing said thermoplastic film along said axis in amounts equal in length to that of said packages;

providing a length of zipper strip having interlocked male and female profiles; said male interlocking profile including a male interlocking member and an integral web defining a male trailing flange, said male interlocking member including a base and a male portion extending from said base; said female interlocking profile including a female interlocking member and an integral web defining a female trailing flange, said female interlocking member including a base and a female portion extending from said base, said male portion being engageable within said female portion to join said male and female interlocking profiles together; at least one of said interlocking members further including at least one high compression member extending from its corresponding base toward the other interlocking member, said at least one high compression member being contactable with the base of other interlocking member when said profiles are interlocked and pressed together so that said interlocking members can be sealed to said thermoplastic film through the application of heat and pressure without damaging or distorting said male and female portions;

disposing said length of zipper strip upon said film transversely to said longitudinal axis with one of said profiles positioned above the other of said profiles and said trailing flanges directed opposite to the direction of motion of said thermoplastic film each time said film is brought to rest;

sealing the lower of said profiles to said thermoplastic film;

forming a package having opposing package walls;

sealing said trailing flanges to opposing inner surfaces of said package walls; and contacting said at least one high compression member with the base of the opposite interlocking member while sealing one of said interlocking members to the inner surface of one of said package walls;

so that said profiles will be on opposing package wall inner surfaces at the package opening.

4. A method according to claim 3 wherein said package is sealed after it is formed.

5. A method according to claim 3 wherein said profiles are sealed to the package adjacent the top end.

6. A method according to claim 3 wherein said zipper strip is disposed upon said thermoplastic film by moving transversely across said longitudinal axis.

7. A method according to claim 3 wherein said package is formed by drawing said thermoplastic film forwardly over a tube to join the longitudinal edges of said thermoplastic film.

8. A method according to claim 3 wherein the longitudinal edges of said thermoplastic film are joined in a back seam prior to sealing said trailing flanges to said package wall inner surfaces.

9. A method according to claim 3 wherein said zipper strip length is substantially equal to one-half the width of said thermoplastic film.

10. The method according to claim 3 wherein said zipper strip is sealed to said thermoplastic film at the center thereof midway between the longitudinal edges.

11. The method according to claim 3 including the step of cross-sealing said film tube above said zipper strip to form the bottom end of a succeeding package.

12. The method according to claim 11 including the step of cutting said thermoplastic film between said cross-seal and said zipper strip to remove a completed package from said thermoplastic film.

13. The method according to claim 3 wherein said lower of said profiles further includes a leading flange extending beyond the other profile which is sealed to said thermoplastic film.

14. A method of making reclosable packages comprising the steps of:

providing thermoplastic film having a longitudinal axis and advancing said thermoplastic film along said axis in amounts equal in length to that of said packages;

providing a length of zipper strip having interlocked male and female profiles; said male interlocking profile including a male interlocking member and an integral web defining a male trailing flange, said male interlocking member including a base and a male portion extending from said base; said female interlocking profile including a female interlocking member and an integral web defining a female trailing flange, said female interlocking member including a base and a female portion extending from said base, said male portion being engageable within said female portion to join said male and female interlocking profiles together; at least one of said interlocking members further including at least one high compression member extending from its corresponding base toward the other interlocking member, said at least one high compression member being contactable with the base of other interlocking member when said profiles are interlocked and pressed together so that said interlocking members can be sealed to said thermoplastic film;

disposing said length of zipper strip upon said film transversely to said longitudinal axis with one of said profiles positioned above the other of said profiles and said trailing flanges directed opposite to the direction of motion of said thermoplastic film each time said film is brought to rest;

sealing the lower of said profiles to said thermoplastic film;

folding said thermoplastic film so as to bring the longitudinal edges together;

sealing the longitudinal edges to form a package having front and back walls;

sealing said trailing flanges to the inner surfaces of said package walls;

contacting said at least one high compression member with the base of the opposite interlocking member while sealing one of said interlocking members to the inner surface of one of said package walls;

cross sealing said package walls to each other above said zipper strip to form the bottom end of a succeeding package; and cutting said thermoplastic film between said cross seal and said zipper strip to remove a completed package from said thermoplastic the film.

15. The method according to claim 14 wherein said lower of said profiles further includes a leading flange extending beyond the other profile which is sealed to said thermoplastic film.

* * * * *